US007510646B2

(12) United States Patent
Catani et al.

(10) Patent No.: US 7,510,646 B2
(45) Date of Patent: Mar. 31, 2009

(54) PROCESS FOR THE PRODUCTION OF HYDROCARBON BLENDS WITH A HIGH OCTANE NUMBER BY THE HYDROGENATION OF HYDROCARBON BLENDS CONTAINING BRANCHED OLEFINIC CUTS

(75) Inventors: Roberto Catani, San Donato Milanese (IT); Marco Di Girolamo, San Donato Milanese (IT); Massimo Conte, San Donato Milanese (IT); Ambrogio Gusberti, Sannazzaro de'Burgondi (IT)

(73) Assignee: Snamprogetti S.p.A., San Donato Milanese (IT)

( * ) Notice: Subject to any disclaimer, the term of this patent is extended or adjusted under 35 U.S.C. 154(b) by 228 days.

(21) Appl. No.: 10/745,512

(22) Filed: Dec. 29, 2003

(65) Prior Publication Data

US 2005/0077211 A1 Apr. 14, 2005

(30) Foreign Application Priority Data

Oct. 10, 2003 (IT) ..... MI2003A1951

(51) Int. Cl.
*C10G 45/00* (2006.01)
*C10G 65/14* (2006.01)

(52) U.S. Cl. ..... 208/144; 208/71; 208/78; 208/80; 208/143; 585/255; 585/510; 585/514

(58) Field of Classification Search ..... 208/71, 208/144, 78, 80, 143; 585/255, 510, 514
See application file for complete search history.

(56) References Cited

U.S. PATENT DOCUMENTS 2,706,211 A * 4/1955 Clark ..... 585/255
4,197,185 A * 4/1980 Le Page et al. ..... 208/71
6,011,191 A * 1/2000 Di Girolamo et al. ..... 585/514
6,433,238 B1 * 8/2002 Di Girolamo et al. ..... 585/510

* cited by examiner

*Primary Examiner*—Glenn Caldarola
*Assistant Examiner*—Prem C. Singh
(74) *Attorney, Agent, or Firm*—Oblon, Spivak, McClelland, Maier & Neustadt, P.C.

(57) ABSTRACT

Process for the production of hydrocarbon blends with a high octane number by the hydrogenation of hydrocarbon blends, containing branched $C_8$, $C_{12}$ and $C_{16}$ olefinic cuts, characterized by sending said blends, as such or fractionated into two streams, one substantially containing the branched $C_8$ olefinic cut, the other substantially containing the branched $C_{12}$ and $C_{16}$ olefinic cuts, to a single hydrogenation zone or to two hydrogenation zones in parallel, respectively, only the stream substantially containing of saturated $C_8$ hydrocarbons, obtained by the fractionation of the stream produced by the single hydrogenation zone or obtained by the hydrogenation zone fed by the fractionated stream substantially containing the branched $C_8$ olefinic cut, being at least partly recycled to the single hydrogenation zone or to the hydrogenation zone fed by the fractionated stream substantially containing the branched $C_8$ olefinic cut, and the hydrocarbon blend with a high octane number, obtained by the fractionation of the stream produced from the single hydrogenation zone or obtained from the hydrogenation zone, being fed by the fractionated stream substantially containing the branched $C_{12}$ and $C_{16}$ olefinic cuts.

14 Claims, 3 Drawing Sheets

PROCESS FOR THE PRODUCTION OF HYDROCARBON BLENDS WITH A HIGH OCTANE NUMBER BY THE HYDROGENATION OF HYDROCARBON BLENDS CONTAINING BRANCHED OLEFINIC CUTS

The present invention relates to a process for the production of hydrocarbon blends with a high octane number by the hydrogenation of hydrocarbon blends containing branched $C_8$, $C_{12}$ and $C_{16}$ olefinic cuts, optionally obtained by the selective dimerization of hydrocarbon cuts containing isobutene.

Refineries throughout the world are currently in the process of producing "Low Environmental Impact Fuels" (characterized by a reduced content of aromatics, olefins, sulfur and a lower volatility), obviously attempting to minimize the effect of their production on the functioning of the refinery itself.

MTBE and alkylated products are the most suitable compounds for satisfying the future demands of refineries, however the use of MTBE is at present hindered by unfavourable legislative regulations whereas alkylated products have a limited availability.

As a result of the continuous attacks on MTBE, due to its poor biodegradability and presumed toxicity, this compound has been banned from fuels in California and in many other states in the USA (50% approximately of the world market); consequently not only is it difficult to foresee its use (together with that of other alkyl ethers) in reformulated fuels in the near future, but rather, the removal of this ether will create considerable problems for refineries as, in addition to its high octane function, MTBE also exerts a diluting action of the most harmful products for the environment (sulfur, aromatics, benzene, etc.).

Alkylated products are undoubtedly ideal compounds for reformulated fuels as they satisfy all the requisites envisaged by future environmental regulations as they combine a high octane number with a low volatility and the practically complete absence of olefins, aromatics and sulfur.

A further positive aspect of alkylation is that it is capable of activating isoparaffinic hydrocarbons, such as, for example, isobutane which binds itself, by reaction in liquid phase catalyzed by strong acids, with olefins (propylene, butanes, pentanes and relative blends) producing saturated $C_7$-$C_9$ hydrocarbons with a high octane number.

Higher productions of alkylated products than those currently available, however, would require the construction of large alkylation units as, due to its scarcity, an alkylated product does not represent a commodity which is widely available at present on the market, but forms a component of gasoline used for captive use in the refineries which produce it.

This represents a great limitation for the large-scale use of alkylated products as the construction of new units is limited by the incompatibility of the catalysts used in traditional processes (hydrochloric acid and sulfuric acid) with the new environmental regulations: processes with hydrochloric due to the dangerous nature of this acid, especially in populated areas, processes with sulfuric acid as a result of its highly corrosive capacity as well as the considerable production of acid mud which is difficult to dispose of.

Alternative processes with solid acid catalysts are being developed but their commercial applicability must still be demonstrated.

In order to face this problem, increasing resort will have to be made to purely hydrocarbon products, such as those obtained by the selective dimerization of $C_3$ and $C_4$ olefins, which, as a result of their octane characteristics (both a high Research Octane Number (RON) and also Motor Octane Number (MON)) and their boiling point (poor volatility but low end point) are included in the range of compositions which are extremely interesting for obtaining gasolines which are more compatible with current environmental demands.

Oligomerization (often incorrectly called polymerization) processes were widely used in refining in the thirties' and forties' to convert low-boiling $C_3$-$C_4$ olefins into so-called "polymer" gasoline. Typical olefins which are oligomerized are mainly propylene, which gives ($C_6$) dimers or slightly higher oligomers depending on the process used, and isobutene which mainly gives ($C_8$) dimers but always accompanied by considerable quantities of higher oligomers ($C_{12}^+$).

This process leads to the production of a gasoline with a high octane number (RON about 97) but also with a high sensitivity due to the purely olefinic characteristic of the product (for more specified details on the process see: J. H. Gary, G. E. Handwerk, "Petroleum Refining: Technology and Economics", 3rd Ed., M. Dekker, New York, (1994), 250). The olefinic nature of the product represents an evident limit to the process as the hydrogenation of these blends always causes a considerable reduction in the octane characteristics of the product, which thus loses its activity.

If we limit our attention to the oligomerization of isobutene, it is known that this reaction is generally carried out with acid catalysts such as phosphoric acid supported on a solid (for example kieselguhr), cationic exchange acid resins, liquid acids such as $H_2SO_4$ or sulfonic acid derivatives, silico-aluminas, mixed oxides, zeolites, fluorinated or chlorinated aluminas, etc.

The main problem of dimerization, which has hindered its industrial development, is the difficulty in controlling the reaction rate; the high activity of all these catalytic species together with the difficulty in controlling the temperature in the reactor, does in fact make it extremely difficult to limit the addition reactions of isobutene to the growing chains and consequently to obtain a high-quality product characterized by a high selectivity to dimers.

In dimerization reactions, there is in fact the formation of excessive percentages of heavy oligomers such as trimers (selectivity of 15-60%) and tetramers (selectivity of 2-10%) of isobutene. Tetramers are completely outside the gasoline fraction as they are too high-boiling and therefore represent a net loss in yield to gasoline; as far as trimers (or their hydrogenated derivatives) are concerned, it is advisable to strongly reduce their concentration as they are characterized by a boiling point (170-180° C.) at the limit of future specifications on the final boiling point of reformulated gasolines.

In order to obtain a better-quality product by reaching higher selectivities (content of dimers >80-85% by weight), it is possible to use different solutions which can moderate the activity of the catalyst and consequently control the reaction rate:

- oxygenated compounds can be used (tertiary alcohol and/or alkyl ether and/or primary alcohol) in a sub-stoichiometric quantity with respect to the isobutene fed in the charge using tubular and/or adiabatic reactors (IT-MI95/A001140 of 1 Jun. 1995, IT-MI97/A001129 of 15 May 1997 and IT-MI99/A001765 of 5 Sep. 1999);
- tertiary alcohols can be used (such as terbutyl alcohol) in a sub-stoichiometric quantity with respect to the isobutene fed in the charge using tubular and/or adiabatic reactors (IT-MI94/A001089 of 27 May 1994;

alternatively, it is possible to suitably modify the charge by mixing the fresh charge with at least a part of the hydrocarbon stream obtained after the separation of the product, so as to optimize the isobutene content (<20% by weight) and use a linear olefin/isobutene ratio greater than 3: in this case, the use of reactors such as tubular or "Boiling Point Reactors" capable of controlling the temperature increase, is fundamental for obtaining high selectivities (IT-MI2000/A001166 of 26 May 2000).

Using these solutions, it is therefore possible to favour the dimerization of isobutene and isobutene/n-butene co-dimerizations, with respect to the oligomerization, and avoid the triggering of oligomerization-polymerization reactions of linear butenes which are favoured by high temperatures.

The dimerization product is then preferably hydrogenated to give a completely saturated final product, with a high octane number and low sensitivity. For illustrative purposes, the octane numbers and relative boiling points of some of the products obtained by the dimerization of isobutene are indicated in the following table.

| PRODUCT | RON | MON | b.p. (° C.) |
|---|---|---|---|
| Diisobutylenes | 100 | 89 | 100-105 |
| Iso-octane | 100 | 100 | 99 |
| Tri-isobutylenes | 100 | 89 | 175-185 |
| Hydrogenated tri-isobutylenes | 101 | 102 | 170-180 |

The hydrogenation of olefins is generally effected using two groups of catalysts:

those based on nickel (20-80% by weight);

those based on noble metals (Pt and/or Pd) supported on a metal content of 0.1-1% by weight.

The operating conditions used for both groups are quite similar; in the case of nickel catalysts, resort must be made however to a higher hydrogen/olefin ratio as these catalysts have a greater tendency towards favouring the cracking of the olefins. Nickel-based catalysts are less costly but become more easily poisoned in the presence of sulfurated compounds; the maximum quantity of sulfur they can tolerate is 1 ppm with respect to approximately 10 ppm tolerated by catalysts based on noble metals. The selection of the type of catalyst to be used therefore depends on the particular charge to be hydrogenated.

A wide range of operating conditions can be adopted for the hydrogenation of olefins; it is possible to operate in vapour phase or in liquid phase but operating conditions in liquid phase are preferred. The reactor configuration can be selected from adiabatic fixed bed reactors, tubular reactors, stirred reactors or column reactors, even if the preferred configuration envisages the use of an adiabatic reactor which can optionally consist of one or more catalytic beds (separated by intermediate cooling).

The hydrogen pressure is preferably below 5 MPa, more preferably between 1 and 3 MPa. The reaction temperature preferably ranges from 30 to 200° C. The feeding space velocities of the olefinic streams are preferably lower than 20 $h^{-1}$, more preferably between 0.2 and 5 $h^{-1}$. The heat which develops from the reaction is generally controlled by diluting the olefinic charge by recycling a part of the hydrogenated product itself (in a ratio: volume of saturated product/volume of olefin lower than 15).

The content of residual olefins in the product depends on the use of the product itself; in the case of blends deriving from the dimerization of isobutene (which can be used as components for gasolines) and having the following average composition

| | |
|---|---|
| $C_8$ | 80-95% by weight |
| $C_{12}$ | 5-20% by weight |
| $C_{16}$ | 0.1-2% by weight |

a content of residual olefins lower than 1% can be considered as being acceptable.

The hydrogenation of a cut having this composition is not a simple operation however, as a series of factors should be taken into account:

the hydrogenation rate is inversely proportional to the chain length; the hydrogenation of $C_8$ olefinic dimers does in fact require much lower temperatures (100-140° C.) with respect to those necessary for the hydrogenation of $C_{12}$ olefins (100-200° C.). In the case of $C_{16}$ olefins, even higher temperatures are obviously necessary. Within the single fractions, moreover, olefins with a terminal double bond are the easiest to hydrogenate.

The reaction temperature must consequently be selected so as to maximize the conversion of $C_{12}$ and $C_{16}$ olefins; in any case it is onerous to operate under such conditions as to completely eliminate these olefins.

The hydrogenation reaction is extremely exothermic and consequently to limit the temperature increase in the adiabatic reactor, the olefinic charge is generally diluted with the hydrogenated product.

The most common hydrogenation catalysts (based on nickel or palladium) tend to become deactivated as a result of the heavy olefins and various poisons such as sulfurated compounds. The greater the number of carbon atoms of the olefins, the slower the hydrogenation kinetics and the greater possibility there is of these olefins being deposited on the catalyst forming coke and reducing its activity. As far as sulfurated compounds are concerned, on the other hand, the presence of sulfur is practically inevitable in this type of charge (almost always greater than 1 ppm and higher in charges from FCC and coking), nickel catalysts are consequently difficult to use whereas those based on supported noble metals are preferred. In the case of charges particularly rich in sulfurated compounds, resort can also be made to bimetallic catalysts such as those used in hydrotreating reactions, for example Ni/Co and/or Ni/Mo.

An effective temperature control is consequently the fundamental point of this type of process. The temperature in the reactor must in fact be kept sufficiently high to kinetically sustain the hydrogenation of heavy olefins but at the same time an excessive increase must be avoided (due to the exothermicity of the reaction) which can activate possible cracking phenomena of the olefins or degeneration of the catalyst (sintering of the metal).

Figure 1:
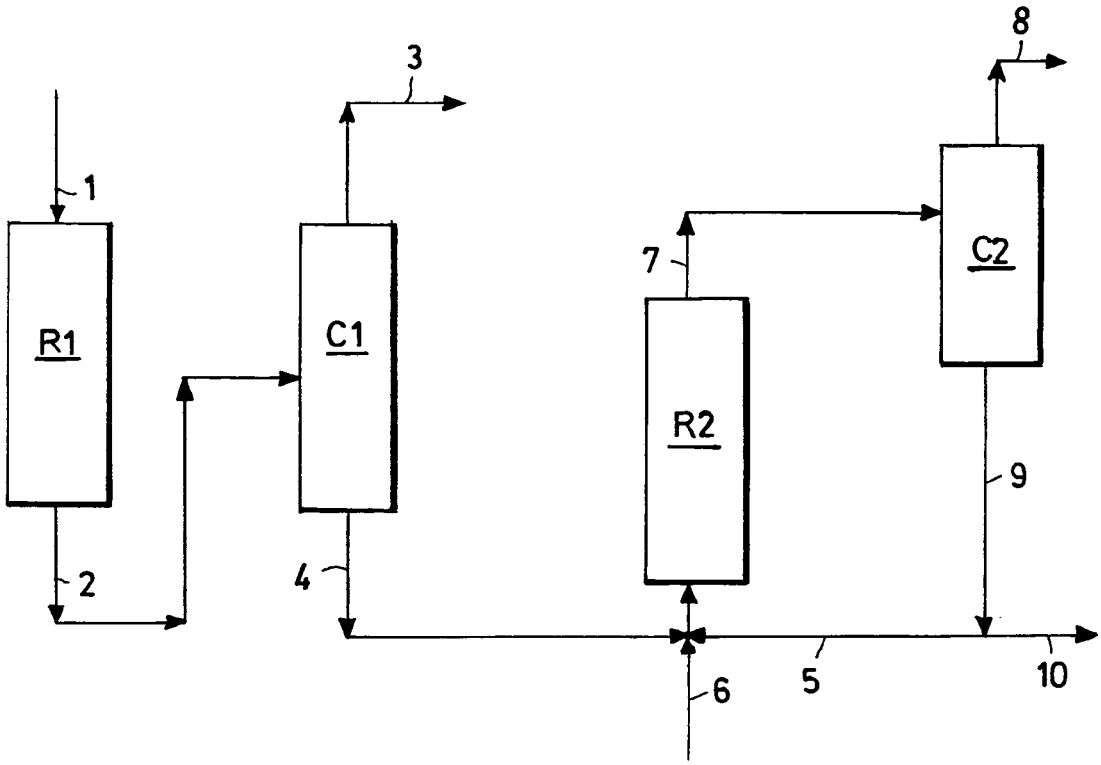
FIG. 1. A classical hydrogenation scheme.

The temperature control in the reactor is generally effected by diluting the olefinic charge with the hydrogenated product (in ratios generally ranging from 0.5 to 20) and FIG. 1 indicates a classical hydrogenation scheme.

The stream (1) containing isobutene, for example coming from Steam-Cracking or Coking or FCC units or from the Dehydrogenation of isobutane, is sent to the reactor (R1) in which the isobutene is selectively converted to dimers.

The effluent (2) from the reactor is sent to a separation column (C1) where a stream (3) essentially containing the non-converted isobutene, linear olefins and saturated $C_4$ products (n-butane and isobutane) is removed at the head, whereas an olefinic stream (4) consisting of dimers and higher oligomers is removed from the bottom, and is fed to the hydrogenation reactor (R2) together with the saturated product (5) and hydrogen (6). The effluent from the reactor (7) is sent to a stabilizing column (C2) from which non-converted hydrogen (8) is recovered at the head whereas the hydrogenated product (9) is obtained at the bottom. A part of this stream (10) leaves the plant whereas the remaining stream is recycled to the reactor.

This plant configuration is valid in the case of the hydrogenation of a single olefinic species (conversions higher than 99%) but may not be effective when, as in the case of the dimerization product of isobutene, there are olefins with hydrocarbon chains and very different reaction rates. In this case, in fact, the difficulty in completely converting the $C_{12}$ and $C_{16}$ olefins negatively influences the feasibility of the whole process; if, in fact, the hydrogenation of $C_{12}$ and $C_{16}$ olefins is not complete, they are recycled to the reactor with a doubly negative effect:

- the tendency of accumulating in the product until it is sent outside specification (total olefins >1% by weight);
- a reduction in the life of the catalyst as these olefins are those which have the greatest tendency to become deposited on the catalyst creating carbonaceous deposits and thus reducing the activity.

An analogous situation can also be caused by the presence of possible poisons (such as sulfurated compounds) which are not completely converted in the hydrogenation reactor.

We have now found a process which is economically more advantageous with respect to a conventional hydrogenation, which envisages the recycling of the whole $C_8$-$C_{16}$ fraction to the reactor, as it is possible to use less drastic reaction conditions and prolong the life of the catalyst.

The process, object of the present invention, for the production of hydrocarbon blends with a high octane number by the hydrogenation of hydrocarbon blends, containing branched $C_8$, $C_{12}$ and $C_{16}$ olefinic cuts, is characterized by sending said blends, as such or fractionated into two streams, one substantially containing the branched $C_8$ olefinic cut, the other substantially containing the branched $C_{12}$ and $C_{16}$ olefinic cuts, to a single hydrogenation zone or to two hydrogenation zones in parallel, respectively, only the stream substantially containing saturated $C_8$ hydrocarbons, obtained by the fractionation of the stream produced by the single hydrogenation zone or obtained by the hydrogenation zone fed by the fractionated stream substantially containing the branched $C_8$ olefinic cut, being at least partly recycled to the single hydrogenation zone or to the hydrogenation zone fed by the fractionated stream substantially containing the branched $C_8$ olefinic cut, and the hydrocarbon blend with a high octane number, obtained by the fractionation of the stream produced from the single hydrogenation zone or obtained from the hydrogenation zone, being fed by the fractionated stream substantially containing the branched $C_{12}$ and $C_{16}$ olefinic cuts.

The $C_8$, $C_{12}$ and $C_{16}$ olefinic cuts contained in the hydrocarbon blends to be treated are preferably oligomers of isobutene, which can derive from the dimerization of isobutene.

In addition to said olefinic cuts, the hydrocarbon blends to be treated can also contain $C_9$-$C_{11}$, and branched $C_{13}$-$C_{15}$ olefinic cuts in lower quantities.

In particular, blends substantially consisting of branched $C_8$-$C_{16}$ olefins are preferably processed according to the invention, wherein branched $C_{12}$ olefins range from 3 to 20% by weight, branched $C_{16}$ olefins range from 0.5 to 5% by weight, the remaining percentage being branched $C_8$ olefins.

When two hydrogenation zones in parallel are adopted, it is advisable for part of the stream substantially containing saturated $C_8$ hydrocarbons, obtained from the hydrogenation zone fed by the fractionated stream substantially containing the branched $C_8$ olefinic cut, to be sent to the hydrogenation zone fed by the fractionated stream substantially containing the branched $C_{12}$ and $C_{16}$ olefinic cuts.

The present invention can be effected by fractionating the high-octane blend either when it is in olefinic form or in hydrogenated form and in both cases its application makes the hydrogenation step of $C_8$-$C_{16}$ olefinic streams technically much simpler.

It is in fact possible to use much blander reaction conditions as there is no longer the necessity of having to maximize the conversion, furthermore the life of the catalyst can be prolonged due to the fact that the heavy hydrocarbons and possible residual olefins are not recycled to the reactor.

More specifically, the process according to the invention in the case of fractionation of the blend in olefinic form, can comprise the following steps:

a) dimerizing the isobutene contained in a $C_4$ cut (FCC, Coking, Steam-Cracking, Dehydrogenation of isobutane);
b) sending the product leaving the dimerization reactor to a first distillation column from whose head the $C_4$ products are recovered, together with, as side cut, a stream rich in branched $C_8$ olefins and as bottom product a stream rich in branched $C_{12}$ and $C_{16}$ olefins;
c) hydrogenating, in a first reactor, the stream rich in branched $C_8$ olefins, obtained as side cut, with suitable catalysts using a part of the $C_8$ products themselves already saturated to dilute the olefinic charge;
d) hydrogenating with suitable catalysts, in a second reactor, the stream rich in branched $C_{12}$ and $C_{16}$ olefins together with the remaining part of the already saturated $C_8$ products, obtaining a saturated high-octane hydrocarbon blend.

If the quantity of $C_8$ products sent to the second reactor is kept equal to that of those removed as side cut of the column, it is possible to have a hydrogenated product having the same distribution as the hydrocarbons (selectivity to $C_8$) of the olefinic product leaving the dimerization step.

The stream rich in branched $C_8$ olefins removed as side cut can be substantially free of hydrocarbon compounds higher than $C_8$.

Figure 2:
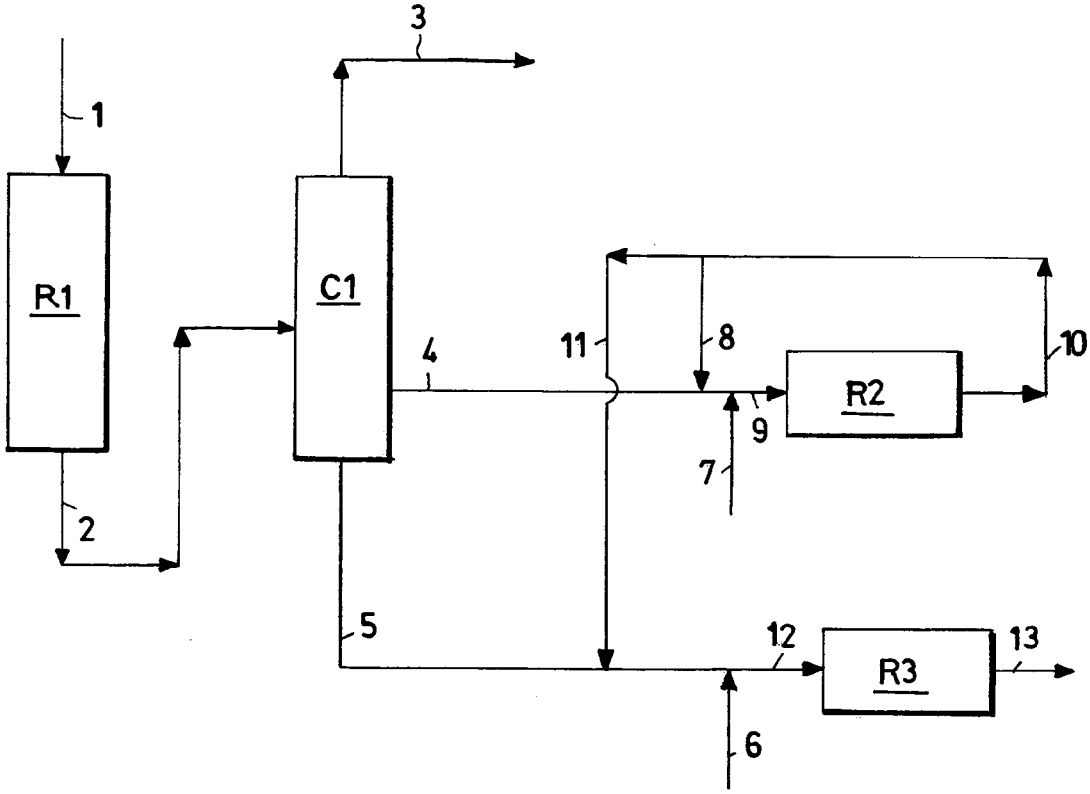
FIG. 2. A simplified process scheme.

A simplified process scheme is shown in FIG. 2 to illustrate this case more clearly.

The $C_4$ stream (1) containing isobutene is sent to the reactor (R1) in which the isobutene is selectively converted to dimers. The effluent (2) from the reactor is sent to a separation column (C1) where a stream (3) essentially containing the non-converted isobutene, linear olefins and saturated $C_4$ products (n-butane and isobutane) is removed at the head, $C_8$ olefins (4) are recovered as side cut whereas a stream (5) in which the higher oligomers ($C_{12}$ and $C_{16}$) are concentrated, is removed at the bottom.

The side cut (4) is sent to the first hydrogenation reactor (R2) together with a part of the saturated $C_8$ products (8) and fresh hydrogen (7). The remaining part of the saturated $C_8$ products and fresh hydrogen (11) is sent, on the other hand, to a second hydrogenation reactor (R3) together with fresh hydrogen (6) and the olefinic stream rich in heavy hydrocarbons (5). The stream (13) which is obtained at the outlet of the reactor forms the plant product.

When, on the other hand, it is the hydrogenated blend which is fractionated, the process according to the invention can comprise the following steps:

a) dimerizing the isobutene contained in a $C_4$ cut (FCC, Coking, Steam-Cracking, Dehydrogenation of isobutane);

b) sending the product leaving the dimerization reactor to a first distillation column from whose head the $C_4$ products are recovered, whereas the $C_8$-$C_{16}$ olefinic blend is recovered from the bottom;

c) hydrogenating the $C_8$-$C_{16}$ olefinic blend with suitable catalysts using a saturated hydrocarbon stream to dilute the olefinic charge;

d) sending the hydrogenation product to one or more distillation columns where the excess hydrogen is recovered, together with a saturated stream rich in $C_8$ olefins, which is recycled to the hydrogenation reactor, and a high-octane hydrocarbon blend (which can also contain $C_{12}$ olefins).

The saturated stream rich in $C_8$ olefins recycled to the reactor, can be substantially free of hydrocarbon compounds higher than $C_8$.

The saturated stream rich in $C_8$ olefins, which is recycled to the hydrogenation reactor, is in a weight ratio preferably ranging from 0.1 to 10 with respect to the olefinic stream at the inlet of the hydrogenation reactor.

Figure 3:
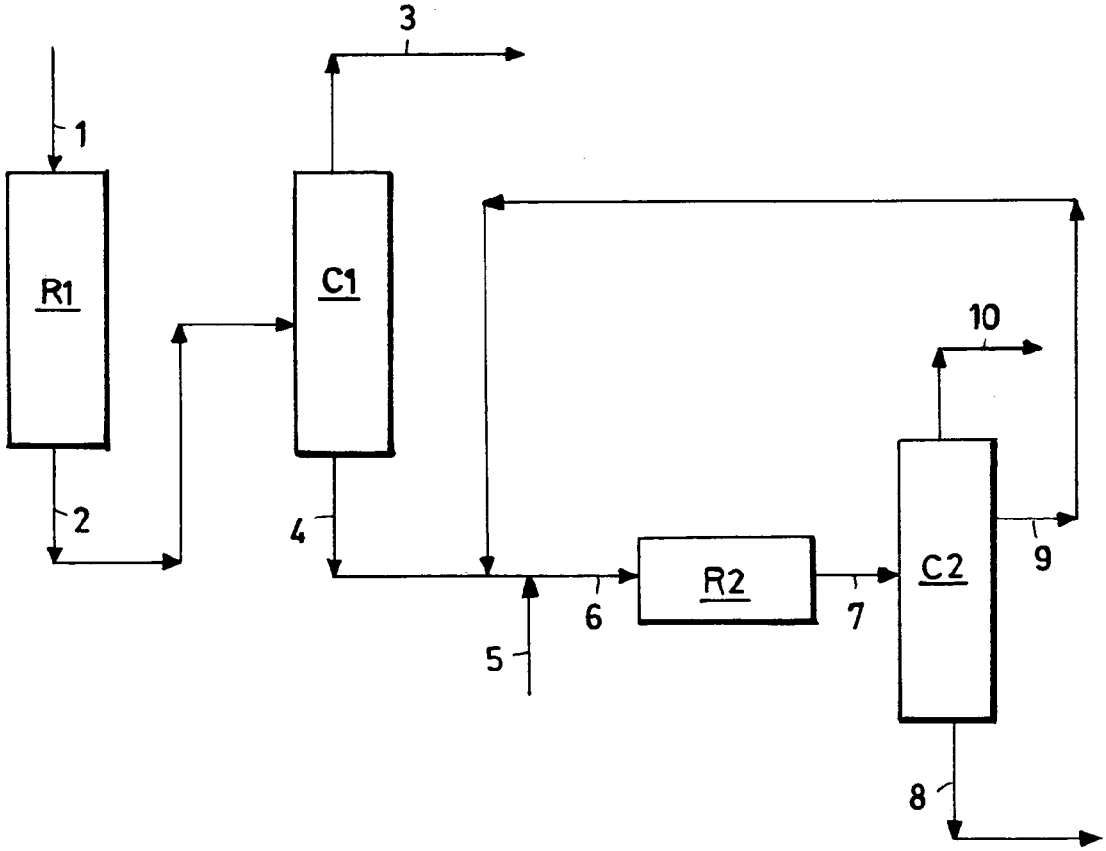
FIG. 3. A simplified process scheme with a new configuration.

A simplified process scheme is shown in FIG. 3 to illustrate this new configuration more clearly.

The $C_4$ stream (1) containing isobutene is sent to the reactor (R1) in which the isobutene is selectively converted to dimers. The effluent (2) from the reactor is sent to a separation column (C1) where a stream (3) essentially containing the non-converted isobutene, linear olefins and saturated $C_4$ products (n-butane and isobutane) is removed at the head, whereas a stream (4) consisting of dimers and higher oligomers is removed at the bottom.

The bottom stream (4) is sent to the hydrogenation reactor (R2) together with the stream of recycled product (9) and fresh hydrogen (5). The effluent from the reactor (7) is then sent to a second distillation column (C2) from which the non-converted hydrogen (10) is recovered from the top, the product containing heavy $C_{12}$ and $C_{16}$ hydrocarbons (8) from the bottom and as side cut, a pure $C_8$ stream (9) which is recycled to the reactor R2.

Optionally, for the separation of the effluent of the hydrogenation reactor, a solution which envisages the use of two distillation columns, can be used.

In both configurations, the hydrogenation catalysts adopted are preferably based on nickel or noble metals.

Some examples are provided for a better illustration of the invention, but which should in no way be considered as limiting its scope.

EXAMPLE 1

This example illustrates a possible process application of the present invention. A hydrocarbon fraction, obtained by the selective dimerization of isobutene and having the following composition:

| | |
|---|---|
| $C_8$ olefins | 90.0% by weight |
| $C_{12}$ olefins | 9.5% by weight |
| $C_{16}$ olefins | 0.5% by weight |

is sent to a hydrogenation reactor (adiabatic with intermediate cooling) together with a stream consisting of saturated $C_8$ hydrocarbons (in a ratio of 1:1) and a stream of hydrogen.

Using a commercial catalyst based on supported palladium and operating in liquid phase with a space velocity of 1 $h^{-1}$ (volumes of olefin with respect to the volume of catalyst per hour), a hydrogen pressure of 3 MPa and an initial temperature of 140° C., the following conversions can be obtained, per passage:

| | |
|---|---|
| Conv. $C_8$ olefins | 99.9% |
| Conv. $C_{12}$ olefins | 93.0% |
| Conv. $C_{16}$ olefins | 60.0% |
| Conv. total olefins | 99.1% |

The reaction effluent is then sent to a distillation column from whose head the excess hydrogen is recovered, as side cut, a saturated $C_8$ stream ($C_{12}$<0.5% by weight), whereas the reaction product is recovered at the bottom. Operating under these conditions, it is possible to obtain a hydrogenated product with a content of residual olefins lower than 1% by weight.

EXAMPLE 2

This examples illustrates another possible use of the process of the present invention which comprises the fractionation of the olefinic stream. A hydrocarbon fraction, obtained by the selective dimerization of isobutene and having the following composition:

| | |
|---|---|
| $C_8$ olefins | 90.0% by weight |
| $C_{12}$ olefins | 9.5% by weight |
| $C_{16}$ olefins | 0.5% by weight |

is sent to a fractionation column where the following two fractions are separated:

| | | |
|---|---|---|
| Head (86%) | $C_8$ olefins | 99.5% |
| | $C_{12}$ olefins | 0.5% |
| Bottom (14%) | $C_8$ olefins | 28.6% |
| | $C_{12}$ olefins | 67.9% |
| | $C_{16}$ olefins | 3.5% |

The $C_8$ olefins collected at the head (86% of the total olefins) are sent to a first hydrogenation reactor (adiabatic with intermediate cooling) together with a stream consisting of saturated $C_8$ products (in a ratio of 1:1) and a stream of hydrogen.

Using a commercial catalyst based on supported palladium and operating in liquid phase with a space velocity of 2 $h^{-1}$, a hydrogen pressure of 3 MPa and an initial temperature of 130° C., 95% of the $C_8$ olefins are converted, per passage.

The bottom product of the column is joined to the remaining part of hydrogenated $C_8$ products (equal in mass to the olefins removed at the head of the column so as to have a final stream still with a total of 90% of $C_8$ hydrocarbons) and sent to a second hydrogenation reactor where, using a commercial catalyst based on supported palladium and operating in liquid phase with a space velocity of 1 $h^{-1}$, a hydrogen pressure of 3 MPa and a temperature of 140° C., the following conversions can be obtained, per passage:

| | |
|---|---|
| Conv. $C_8$ olefins | 99.9% |
| Conv. $C_{12}$ olefins | 93.0% |
| Conv. $C_{16}$ olefins | 60.0% |
| Conv. total olefins | 95.5% |

Operating under these conditions, it is possible to obtain a hydrogenated product with a content of residual olefins lower than 1% by weight.

EXAMPLE 3 (COMPARATIVE)

This example shows how, using a classical hydrogenation scheme, it is necessary to resort to much more drastic reaction conditions to completely eliminate the olefins from the product. In this case, in fact, in order to control the reaction heat, a part of the product is recycled to the reactor and consequently the content of residual olefins must be minimized.

The hydrogenation of the olefinic blend, whose composition is the same as Examples 1 and 2, is always carried out in liquid phase with a commercial catalyst based on supported palladium, a hydrogen pressure of 3 MPa but with a space velocity of 0.5 $h^{-1}$, and a temperature of 150° C., necessary for obtaining conversions of $C_{12}$ and $C_{16}$ olefins of over 99%.

In this case, the process is much less economical with respect to the previous examples (greater quantity of catalyst and higher temperatures).

The invention claimed is:

1. A process for the production of hydrocarbon blends with a high octane number by the hydrogenation of hydrocarbon blends, containing branched $C_8$, $C_{12}$ and $C_{16}$ olefinic cuts, characterized by sending said blends, as such or fractionated into two streams, one substantially consisting of the branched $C_8$ olefinic cut, the other substantially containing the branched $C_{12}$ and $C_{16}$ olefinic cuts, to a single hydrogenation zone or to two hydrogenation zones in parallel, respectively, only the stream substantially consisting of saturated $C_8$ hydrocarbons, obtained by the fractionation of the stream produced by the single hydrogenation zone or obtained by the hydrogenation zone fed by the fractionated stream substantially consisting of the branched $C_8$ olefinic cut, being at least partly recycled to the single hydrogenation zone or to the hydrogenation zone fed by the fractionated stream substantially consisting of the branched $C_8$ olefinic cut, and to said hydrogenation zone fed by the fractionated stream substantially containing the branched $C_{12}$ and $C_{16}$ olefinic cuts.

2. The process according to claim 1, wherein the branched $C_8$, $C_{12}$ and $C_{16}$ olefinic cuts are oligomers of isobutene.

3. The process according to claim 2, wherein the branched $C_8$, $C_{12}$ and $C_{16}$ olefinic cuts, oligomers of isobutene, derive from the dimerization of isobutene.

4. The process according to claim 1, wherein the hydrocarbon blends consisting of branched $C_8$, $C_{12}$ and $C_{16}$ olefinic cuts also contain branched $C_9$-$C_{11}$ and $C_{13}$-$C_{15}$ olefinic cuts, in a smaller quantity.

5. The process according to claim 1, wherein part of the stream substantially consisting of saturated $C_8$ hydrocarbons, obtained from the hydrogenation zone fed by the fractionated stream substantially consisting of the branched $C_8$ olefinic cut, is sent to the hydrogenation zone fed by the fractionated stream substantially containing the branched $C_{12}$ and $C_{16}$ olefinic cuts.

6. The process according to claims 1, 2 or 3, comprising the following steps: a) dimerizing the isobutene contained in a $C_4$ cut; b) sending the product leaving the dimerization reactor to a first distillation column from whose head the $C_4$ products are recovered, together with, as side cut, a stream rich in branched $C_8$ olefins and as bottom product a stream rich in branched $C_{12}$ and $C_{16}$ olefins; c) hydrogenating, in a first reactor, the stream rich in branched $C_8$ olefins, obtained as side cut, with suitable catalysts using a part of the same $C_8$ products already saturated to dilute the olefinic charge; d) hydrogenating with suitable catalysts, in a second reactor, the stream rich in branched $C_{12}$ and $C_{16}$ olefins together with the remaining part of the already saturated $C_8$ products, obtaining a saturated high-octane hydrocarbon blend.

7. The process according to claim 1, wherein the stream rich in branched $C_8$ olefins removed as side cut is substantially free of hydrocarbon compounds higher than $C_8$.

8. The process according to claims 1 or 3, comprising the following steps: a) dimerizing the isobutene contained in a $C_4$ cut; b) sending the product leaving the dimerization reactor to a first distillation column from whose head the $C_4$ products are recovered, whereas the $C_8$-$C_{16}$ olefinic blend is recovered from the bottom; c) hydrogenating the $C_8$-$C_{16}$ olefinic blend with suitable catalysts using a saturated hydrocarbon stream to dilute the olefinic charge; d) sending the hydrogenation product to one or more distillation columns where the excess hydrogen is recovered, together with a saturated stream rich in $C_8$ olefins, which is recycled to the hydrogenation reactor, and a high-octane hydrocarbon blend.

9. The process according to claim 1, wherein the saturated stream rich in $C_8$ products recycled to the hydrogenation reactor, is in a weight ratio ranging from 0.1 to 10 with respect to the olefinic stream at the inlet of the hydrogenation reactor.

10. The process according to claim 1, wherein the saturated stream rich in $C_8$ products recycled to the reactor, is substantially free of hydrocarbon compounds higher than $C_8$.

11. The process according to claim 6, wherein the hydrogenation catalysts are based on nickel or noble metals.

12. The process according to claim 1, wherein the blends substantially consist of branched $C_8$-$C_{16}$ olefins, wherein the branched $C_{12}$ olefins range from 3 to 20% by weight, the branched $C_{16}$ olefins range from 0.5 to 5% by weight, the remaining percentage being the branched $C_8$ olefins.

13. The process according to claim 1, wherein the stream substantially consisting of saturated $C_8$ hydrocarbons has a content of $C_{12}$ olefins less than or equal to 0.5% by weight.

14. The process according to claim 1, wherein the stream substantially consisting of saturated $C_8$ hydrocarbons has a content of saturate $C_8$ greater than or equal to 99.5% by weight.

* * * * *